US006111223A

United States Patent [19]

Tatematsu

[11] Patent Number: 6,111,223

[45] Date of Patent: Aug. 29, 2000

[54] CERAMIC GLOW PLUG HAVING PORTION OF HEATER WITHIN METALLIC SLEEVE

[75] Inventor: Kazuho Tatematsu, Aichi, Japan

[73] Assignee: NGK Spark Plug Co., Ltd., Nagoya, Japan

[21] Appl. No.: 09/261,650

[22] Filed: Mar. 3, 1999

[30] Foreign Application Priority Data

Mar. 10, 1998 [JP] Japan ..... 10-075052

[51] Int. Cl.[7] ..... F23Q 7/00

[52] U.S. Cl. ..... 219/270; 219/544; 123/145 A

[58] Field of Search ..... 219/270, 544, 219/552, 553; 123/145 A, 145 R; 361/264–266; 338/220

[56] References Cited

U.S. PATENT DOCUMENTS

| | | | |
|---|---|---|---|
| 4,346,679 | 8/1982 | Knowles | 123/145 A |
| 4,636,614 | 1/1987 | Itoh et al. | 219/270 |
| 4,650,963 | 3/1987 | Yokoi | 219/270 |
| 4,719,331 | 1/1988 | Ito et al. | 219/270 |
| 4,914,274 | 4/1990 | Hatanaka et al. | 219/270 |
| 5,218,183 | 6/1993 | Kimata | 219/270 |
| 5,519,187 | 5/1996 | Hinkle | 219/270 |
| 5,676,100 | 10/1997 | Dam et al. | 123/145 A |

FOREIGN PATENT DOCUMENTS

| | | | |
|---|---|---|---|
| 59-231321 | 12/1984 | Japan . | |
| 61-8526 | 1/1986 | Japan | 219/270 |
| 4-143518 | 5/1992 | Japan . | |
| 4-263702 | 9/1992 | Japan | 219/270 |
| 4-288410 | 10/1992 | Japan | 219/270 |
| 9-190874 | 7/1997 | Japan . | |
| 9-303774 | 11/1997 | Japan . | |

*Primary Examiner*—John A. Jeffery
*Attorney, Agent, or Firm*—Brinks Hofer Gilson & Lione

[57] ABSTRACT

A ceramic heater is composed of an insulating ceramic heater body, a metallic sleeve fitted onto the ceramic heater body, a resistance heating element formed of a metal or a nonmetallic material and embedded in the ceramic heater body, and electrode leads. The length of a portion of the resistance heating element located inside the metallic sleeve is set equal to or greater than the length of a portion of the resistance heating element located outside the metallic sleeve. The resistance heating element has a heating portion which has a resistance per unit length which is twice that of the remaining portion or greater. The heating portion has a length 30 to 100% the length of the portion of the resistance heating element located outside the metallic sleeve.

9 Claims, 5 Drawing Sheets

FIG. 3

| | | LENGTH OF HEATING ELEMENT (A) | LENGTH OF PORTION LOCATED INSIDE OF METALLIC SLEEVE (B) | LENGTH OF PORTION LOCATED OUTSIDE OF METALLIC SLEEVE (C) | LENGTH OF HEATING PORTION (D) | B/C | D/C ×100 (%) | TEMPERATURE AFTER 5 SEC. (℃) | DURABILITY TEST UNDER APPLICATION OF ELECTRICITY (1400°C FOR 1 MIN. ON-OFF) |
|---|---|---|---|---|---|---|---|---|---|
| EXAMPLE | 1 | 18 | 10 | 8 | 4.5 | 1.25 | 56.3 | 1030 | OK AFTER 10000 CYCLES |
| | 2 | 21 | 13 | 8 | 4.5 | 1.63 | 56.3 | 1042 | 〃 |
| | 3 | 24 | 16 | 8 | 4.5 | 2.0 | 56.3 | 1052 | 〃 |
| | 4 | 29 | 21 | 8 | 4.5 | 2.63 | 56.3 | 1050 | 〃 |
| | 5 | 34 | 26 | 8 | 4.5 | 3.25 | 56.3 | 1052 | 〃 |
| | 6 | 24 | 16 | 8 | 2.5 | 2.0 | 31.3 | 1055 | 〃 |
| | 7 | 24 | 16 | 8 | 6.0 | 2.0 | 75.0 | 1050 | 〃 |
| | 8 | 24 | 16 | 8 | 8.0 | 2.0 | 100 | 1035 | 〃 |
| COMPARATIVE EX. | 9 | 14 | 6 | 8 | 4.5 | 0.75 | 56.3 | 995 | 〃 |
| | 10 | 12 | 4 | 8 | 4.5 | 0.50 | 56.3 | 975 | 〃 |
| | 11 | 24 | 16 | 8 | 2.0 | 2.0 | 25.0 | 1054 | BURNOUT AFTER 4000 CYCLES |
| | 12 | 24 | 16 | 8 | 9.0 | 2.0 | 25.0 | 1024 | BRAZING MATERIAL DISAPPEARED AFTER 2000 CYCLES |

CERAMIC GLOW PLUG HAVING PORTION OF HEATER WITHIN METALLIC SLEEVE

BACKGROUND OF THE INVENTION

1. Field of the Invention

The present invention relates to a ceramic heater used in a ceramic glow plug attached to a diesel engine or the like.

2. Description of the Related Art

A conventional ceramic heater for a ceramic glow plug attached to a diesel engine is composed of a bar-shaped insulating ceramic heater body, a metallic sleeve fitted onto the ceramic heater body, a resistance heating element formed of a metal or a nonmetallic material and embedded in the ceramic heater body, and electrode leads. Such conventional ceramic heaters can be divided into two types, which differ according to the structure employed for establishing connection between the electrode lead of a ceramic heater and an intermediate shaft having one end fixedly held within a metallic sleeve of a ceramic glow plug. In a ceramic heater of one type, a temperature control resistor is interposed between the intermediate shaft of the glow plug and a lead coil connected to the electrode lead of the ceramic heater. In a ceramic heater of the other type, the intermediate shaft of the glow plug is connected directly to the lead coil.

In the ceramic heater in which a temperature control resistor is interposed between the intermediate shaft of the glow plug and a lead coil connected to the electrode lead of the ceramic heater, the temperature control resistor allows the embedded resistance heating element to quickly increase its temperature, to thereby generate a sufficient amount of heat for starting an engine. However, since the temperature control resistor must be incorporated within the metallic shell, the manufacturing cost increases, resulting in an expensive ceramic glow plug.

By contrast, in the ceramic heater in which the intermediate shaft of the glow plug is connected directly to the lead coil, the above-mentioned quick temperature increase achieved by the embedded resistant heating element is not expected. Since no temperature control resistor is used, the structure for establishing connection between the intermediate shaft and the ceramic heater is simple. However, in order to impart sufficient engine starting performance to a ceramic glow plug utilizing such a ceramic heater, the following point must be considered in design of the ceramic heater. That is, measures for generating a sufficient amount of heat through a quick temperature increase include raising the saturation temperature of the resistance heating element greatly or employing a controller for controlling application voltage. However, when the saturation temperature of the resistance heating element is increased excessively, the durability of the ceramic heater itself decreases. When a controller for controlling application voltage is employed, the complicated structure of the controller considerably increases the overall cost of the product.

SUMMARY OF THE INVENTION

In view of the above-mentioned problems in the prior art, an object of the present invention is to provide a ceramic heater which is inexpensive and has improved durability and which enables a resistance heating element to quickly raise the temperature of the heater to thereby secure good engine-staring performance.

To achieve the above-described object, a ceramic heater of the present invention comprises a ceramic heater body formed of insulating ceramics, a metallic sleeve fitted onto the ceramic heater body, a resistance heating element embedded in the ceramic heater body, and electrode leads. The length of a portion of the resistance heating element located inside the metallic sleeve is set equal to or greater than the length of a portion of the resistance heating element located outside the metallic sleeve. The resistance heating element has a heating portion having a resistance per unit length which is twice that of the remaining portion or greater. The heating portion has a length 30 to 100% that of the portion of the resistance heating element located outside the metallic sleeve.

By virtue of the above-described structure, the temperature of the resistance heating element of the ceramic heater can be raised quickly by means of a self-control function, without employment of a temperature control resistor or a voltage control controller and without excessive increase of the saturation voltage. Further, since the area of the heating portion can be maximized, a ceramic glow plug utilizing the ceramic heater of the present invention has good engine starting performance and can be produced at low cost. Further, the durability of the ceramic glow plug can be improved to a sufficient degree.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which:

FIG. 3 is a table showing the results of an endurance test performed on the ceramic heater of the first embodiment while electricity was applied thereto;

DESCRIPTION OF THE PREFERRED EMBODIMENTS

In the present invention, if the length of the portion of the resistance heating element located inside the metallic sleeve is set to less than the length of the portion of the resistance heating element located outside the metallic sleeve, a sufficient self-control function cannot be attained. Also, if the ratio of the length of the portion of the resistance heating element located inside the metallic sleeve to the length of the portion of the resistance heating element located outside the metallic sleeve is increased to three or greater, an attained self-control function is almost the same as that obtained in the case where the ratio is two. Therefore, the self-control function reaches a sufficient level when the length of the portion of the resistance heating element located inside the metallic sleeve is set greater than the length of the portion of the resistance heating element located outside the metallic sleeve. The reason for this is as follows: when a voltage is applied to the ceramic heater, the resistance heating element having a uniform resistivity generates heat uniformly at the beginning of the temperature increase. However, the heat generated at a portion of the resistance heating element located inside the metallic sleeve is radiated onto the metallic sleeve via the insulating portion and further to an engine with which the ceramic heater is in contact via the metallic sleeve. As a result, the speed of heating by the portion of the ceramic located inside the metallic sleeve is slower than that at the tip end portion of the ceramic located outside the metallic sleeve. This produces a temperature difference within the ceramic heater such that the temperature at the tip end portion of the resistance heating element outside the metallic sleeve becomes higher than that at the portion of the resistance heating element inside the metallic sleeve.

Further, this temperature difference results in a difference in the resistance of the heating element, so that the resistance of the heating element increases toward the tip end of the ceramic heater, and the amount of generated heat also increases toward the tip end of the ceramic heater. However, in the second half of the temperature increase period, a temperature increase occurs even at the portion of the resistance heating element located inside the metallic sleeve. Thus, the amount of consumed energy at that portion increases, so that a temperature control function similar to that obtained through employment of a temperature control resistor is attained. Therefore, the temperature of the resistance heating element of the ceramic heater can be raised quickly without employment of a temperature control resistor or a voltage control controller and without excess increase of the saturation voltage.

Figure 2:
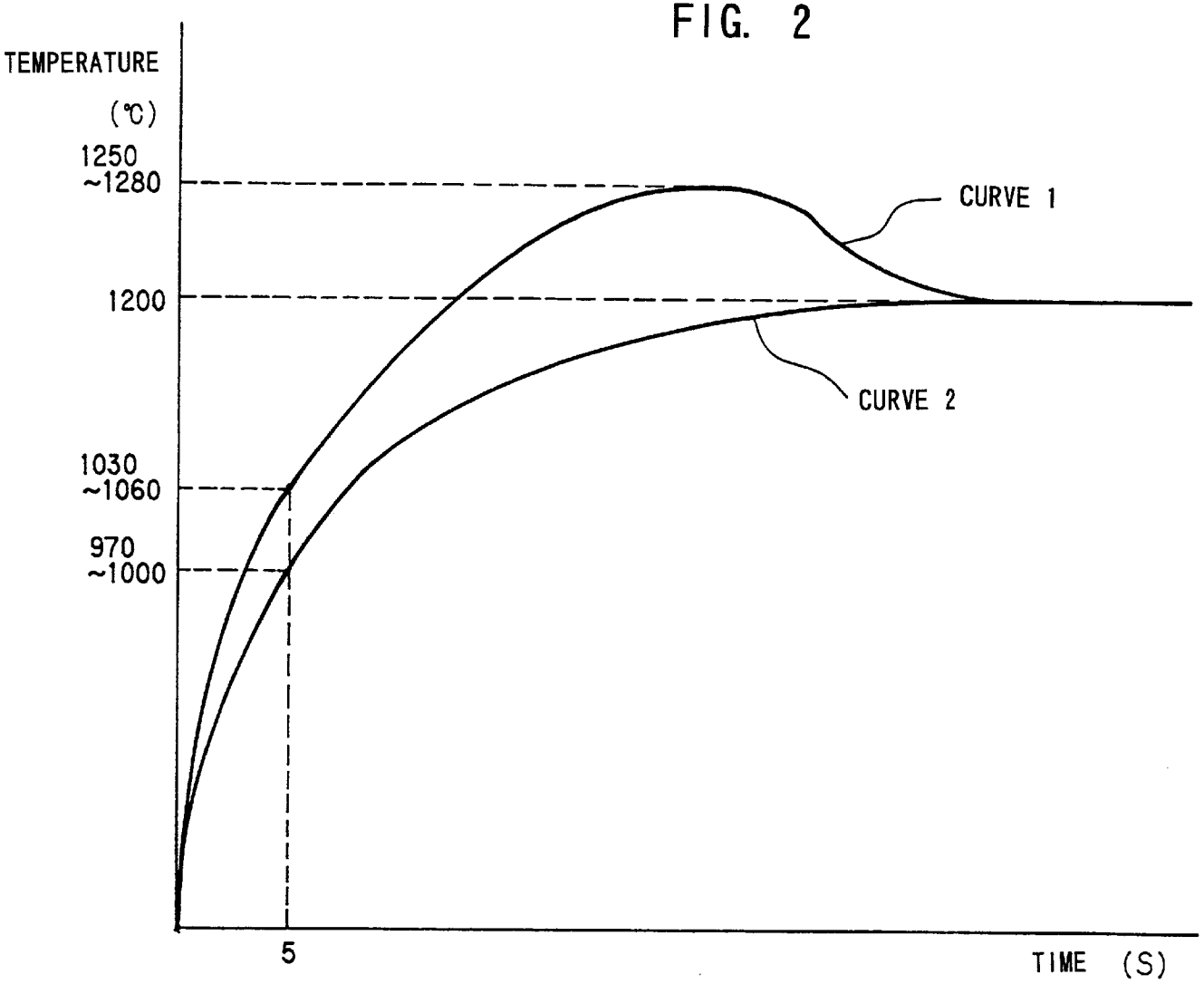
FIG. 2 is a graph showing temperature increase of a ceramic heater in which the ratio of the length of a portion of the resistance heating element located inside a metallic sleeve to the length of a portion of the resistance heating element located outside the metallic sleeve is greater than 1, as well as temperature increase of a ceramic heater in which the length ratio is less than 1.

In FIG. 2, curve 1 shows temperature increase of a ceramic heater in which the ratio of the length of a portion of the resistance heating element located inside a metallic sleeve to the length of a portion of the resistance heating element located outside the metallic sleeve is greater than 1, and curve 2 shows temperature increase of a ceramic heater in which the length ratio is less than 1. As is apparent from FIG. 2, when the ratio is less than 1, a natural saturation occurs. By contrast, when the ratio is equal to or greater than 1, the temperature at the heating portion of the resistance heating element extending from the front edge of the metallic sleeve to the tip end of the ceramic heater body increases temporarily to 1250–1280° C. Subsequently, a temperature increase occurs at the portion of the resistance heating element located inside the metallic sleeve fitted onto the ceramic heater body, so that the amount of consumed energy is increased, and thus the amount of energy supplied to the heating portion decreases. As a result, the temperature at the heating portion decreases to 1200° C. This characteristic is the same as that of a ceramic heater that contains a temperature control resistor. Further, since the peak temperature becomes greater than the saturation temperature (e.g., 1200° C.), a quick temperature increase is enabled.

Further, in order to ensure that a ceramic glow plug utilizing the ceramic heater of the present invention has good engine starting performance, the heating portion of the resistance heating element located outside the metallic sleeve preferably has a maximum area within the range that allows rapid temperature increase at the heating portion. If the length of the heating portion is not greater than 30% the length of the portion of the resistance heating element located outside the metallic sleeve, the heat generating portion can raise the temperature locally, but heat is generated in a small region in a concentrated manner, resulting in degraded durability under application of electricity. Further, since the area of the heat generating portion becomes small, the engine starting performance deteriorates. By contrast, if the length of the heating portion is not less than 100% the length of the portion of the resistance heating element located outside the metallic sleeve, heat is generated even within the metallic sleeve fitted onto the ceramic heater body. Accordingly, a brazing filler material joining together the ceramic heater body and the metallic sleeve fitted thereon melts and disappears, resulting in possible breakage of the ceramic heater itself. In view of the foregoing, the length of the heating portion of the resistance heating element is set to 30 to 100% the length of the portion of the resistance heating element located outside the metallic sleeve. Through this design, the area of the heating portion can be maximized in order to ensure that a ceramic glow plug utilizing the ceramic heater of the present invention has good engine starting performance.

The present invention will now be described in more detail with reference to embodiments shown in the drawings.

Figure 1:
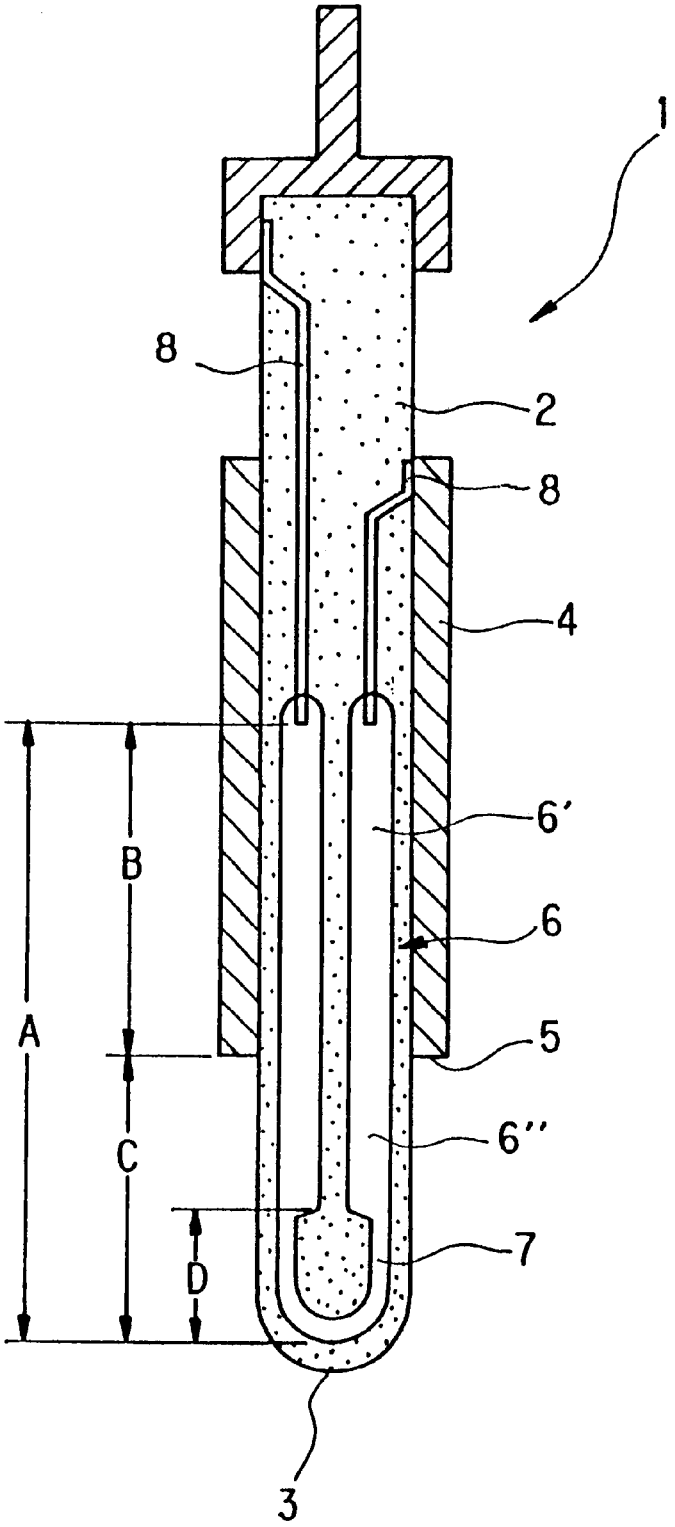
FIG. 1 is an enlarged, cross-sectional view of a ceramic heater according to a first embodiment of the present invention which has a resistance heating element formed of a metallic coil.

As shown in FIG. 1, a ceramic heater 1 is composed of a bar-shaped insulating ceramic heater body 2, a metallic sleeve 4 fitted onto the ceramic heater body 2, a resistance heating element 6 formed of a metal or a nonmetallic material and embedded in the ceramic heater body 2, and electrode leads 8.

The ceramic heater 1 is manufactured by, for example, the method described in U.S. patent application Ser. Nos. 08/826,144, 08/827,160, or 09/060,474, which are incorporated herein by reference.

The length of a portion 6' of the resistance heating element 6 located inside the metallic sleeve 4 is set equal to or greater than the length of a portion 6" of the resistance heating element 6 located outside the metallic sleeve 4.

The resistance heating element 6 has a heating portion 7 which has a resistance per unit length which is twice that of the remaining portion or greater. The heating portion 7 has a length 30 to 100% the length of the portion 6" of the resistance heating element 6 located outside the metallic sleeve 4.

The ceramic heater 1 according to the present embodiment has the structure as described above. Since the length of the portion 6' of the resistance heating element 6 located inside the metallic sleeve 4 is set equal to or greater than the length of the portion 6" of the resistance heating element 6 located outside the metallic sleeve 4, a sufficient self-control function is attained. When a voltage is applied to the ceramic heater 1 of the present embodiment, a temperature increase arises at the heating portion 7 of the portion 6" of the resistance heating element 6 located outside the metallic sleeve 4, and when the temperature increase enters a second half period, a temperature increase arises at the portion 6' of the resistance heating element 6 located inside the metallic sleeve 4. As a result, the amount of consumed energy increases, so that a temperature control function similar to that obtained through employment of a temperature control resistor is attained. Therefore, the temperature of the resistance heating element 6 of the ceramic heater 1 can be increased quickly without employment of a temperature control resistor or a voltage control controller and without excess increase of the saturation voltage.

Further, in order to ensure that a ceramic glow plug utilizing the ceramic heater of the present embodiment has good engine starting performance, the heating portion 7 of the portion 6" of the resistance heating element 6 located outside the metallic sleeve 4 preferably has a maximum area within the range that allows rapid temperature increase at the heating portion 7. Therefore, the length of the heating portion 7 is set to 30 to 100% the length of the portion 6" of the resistance heating element 6 located outside the metallic sleeve 4. Through this design, the area of the heating portion 7 can be maximized in order to ensure that a ceramic glow plug utilizing the ceramic heater of the present embodiment has good engine starting performance.

In order to evaluate the ceramic heater of the present embodiment in terms of temperature increasing performance and durability under application of electricity, a test was performed through use of an actual engine under various conditions, and the test results were compared and studied. The table of FIG. 3 shows the test results. The overall length of the resistance heating element 6 embedded in the ceramic heater body 2 of the ceramic heater 1 is taken as A, and the length of a portion 6' of the resistance heating element 6 located inside the metallic sleeve 4 is taken as B. Further, the length of a portion 6" of the resistance heating element 6 located outside the metallic sleeve 4 is taken as C, and the length of the heating portion 7 of the resistance heating element 6 is taken as D. Therefore, the ratio B/C represents the ratio of the length of the portion 6' of the resistance heating element 4 located inside the metallic sleeve 4 to the length of the portion 6" of the resistance heating element 6 located outside the metallic sleeve 4, and the ratio D/C represents the ratio of the length of the heating portion 7 to the length of the portion 6" of the resistance heating element 6 located outside the metallic sleeve 4. Ceramic heaters whose heating portions 7 had different lengths and which had a saturation temperature of 1200° C. were produced. A temperature after application of electricity for 5 seconds was measured as temperature-increasing performance. Further, electricity was applied to the ceramic heater such that the ceramic heater generated heat at 1400° C. for one minute, after which the application of electricity was stopped. This operation was regarded as one cycle. For each heater, the number of cycles until the heating portion 7 suffered burnout was measured. The test results demonstrate the effect of the present invention.

Figure 4A:
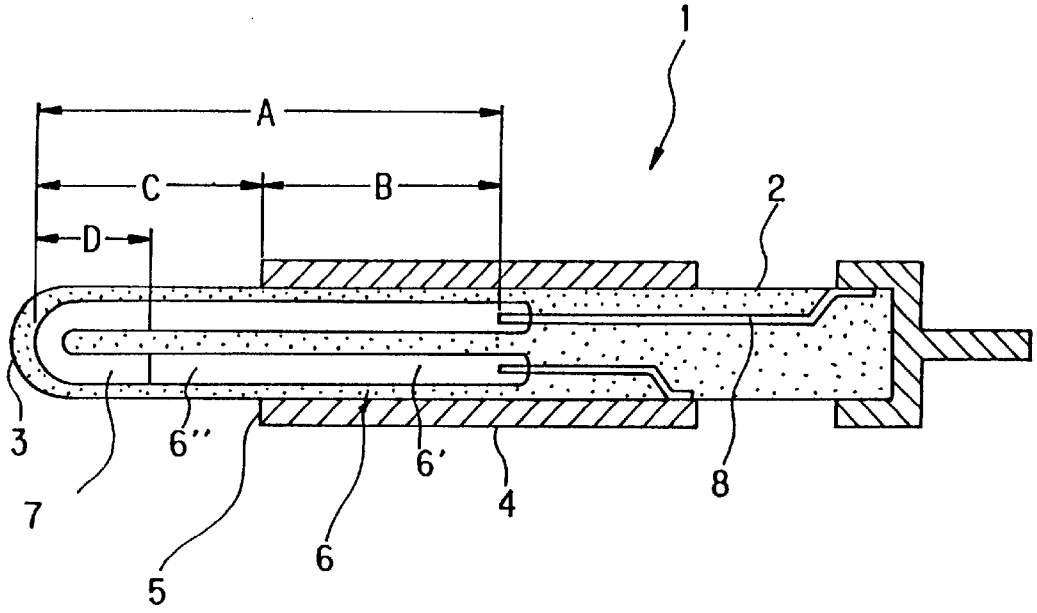
FIG. 4A is an enlarged, cross-sectional view of a ceramic heater according to a second embodiment of the present invention which has a resistance heating element formed through printing.
Figure 4B:
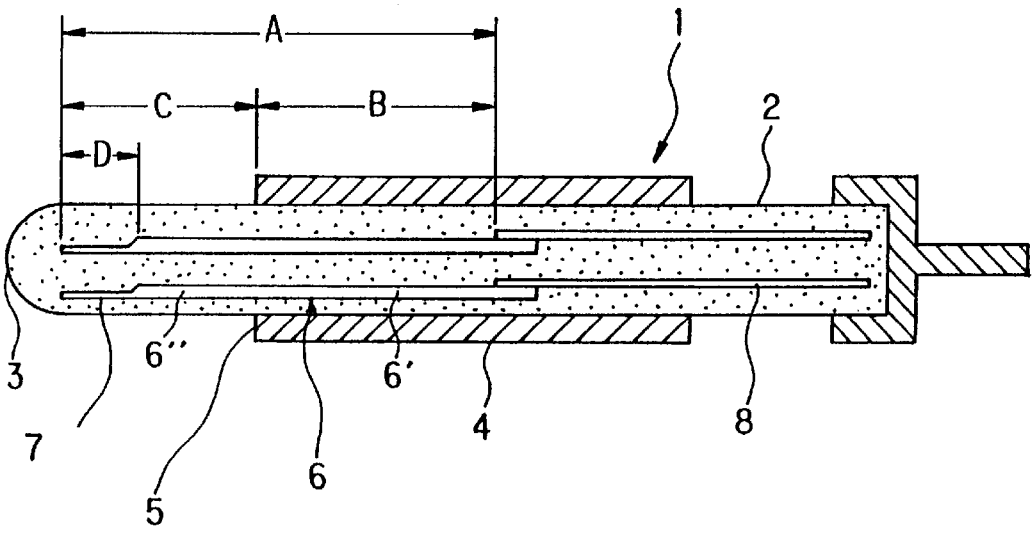
FIG. 4B is another enlarged, cross-sectional view of the ceramic heater of FIG. 4A sectioned at an angular position shifted 90° from the position of FIG. 4A.
Figure 5:
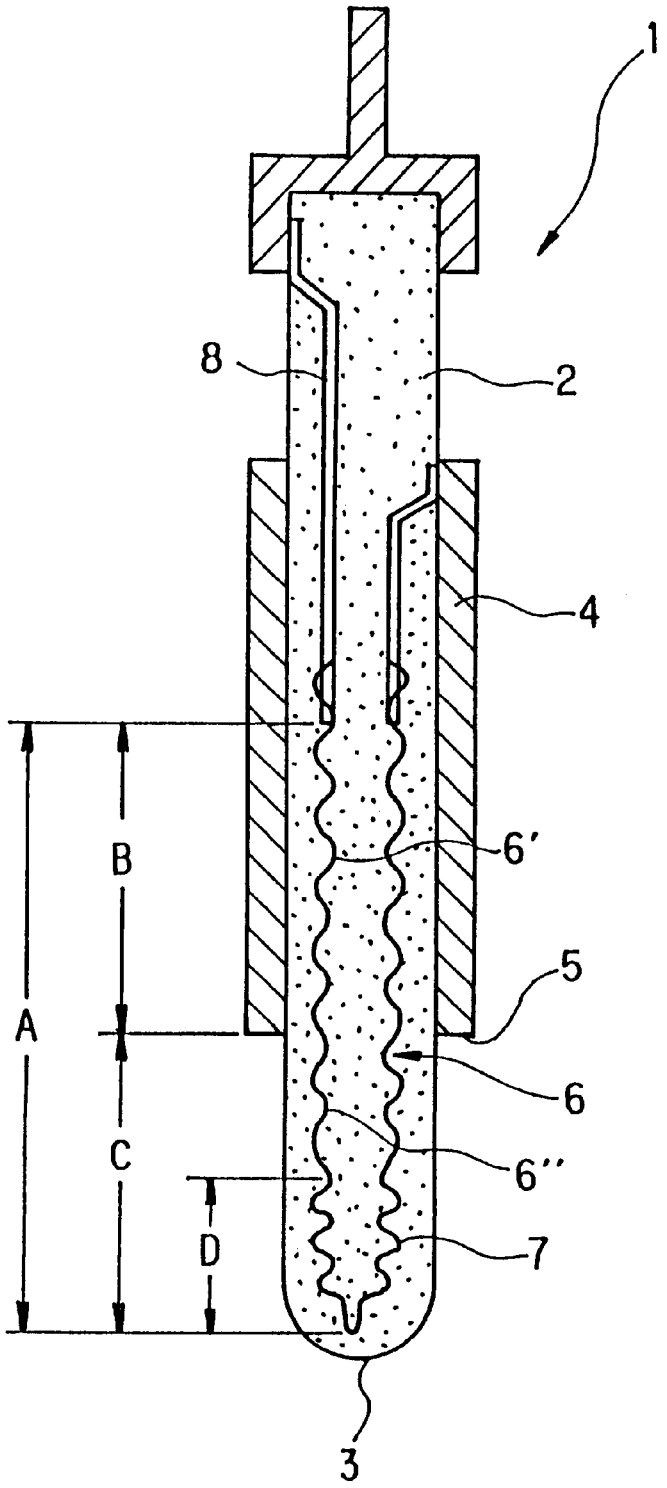
FIG. 5 is an enlarged, cross-sectional view of a ceramic heater according to a third embodiment of the present invention which has a resistance heating element formed through injection molding.

The length of the portion 6" of the resistance heating element 6 located outside the metallic sleeve 4 relates to the resistance of the resistance heating element 6 embedded in the ceramic heater body 2 of the ceramic heater 1. However, the length of a portion 6" also changes depending on the kind of engine or the like. The above-described dimensional relationships can be applied to a ceramic heater which has a resistance heating element formed through printing (shown in FIGS. 4A and 4B), as well as to a ceramic heater which has a resistance heating element formed through injection molding (shown in FIG. 5).

Obviously, numerous modifications and variations of the present invention are possible in light of the above teachings. It is therefore to be understood that within the scope of the appended claims, the present invention may be practiced otherwise than as specifically described herein.

I claim:

1. A ceramic heater comprising:

a ceramic heater body formed of insulating ceramics;

a metallic sleeve fitted onto the ceramic heater body;

a resistance heating element embedded in the ceramic heater body, the resistance heating element including a control portion and a heating portion having a resistance per unit length which is at least twice that of the control portion, the heating portion having a length 30% to 100% that of the portion of the resistance heating element located outside the metallic sleeve; and electrode leads, wherein the length of a portion of the resistance heating element located inside the metallic sleeve is equal to or greater than the length of a portion of the resistance heating element located outside the metallic sleeve.

2. A ceramic glow plug comprising the ceramic heater according to claim 1.

3. A ceramic heater according to claim 1, wherein the resistance heating element is formed of a metal.

4. A ceramic heater according to claim 3, wherein the resistance heating element is formed through printing.

5. A ceramic heater according to claim 3, wherein the resistance heating element is formed through injection molding.

6. A ceramic heater according to claim 1, wherein the resistance heating element is formed of a nonmetallic material.

7. A ceramic heater according to claim 6, wherein the resistance heating element is formed through printing.

8. A ceramic heater according to claim 6, wherein the resistance heating element is formed through injection molding.

9. A ceramic glow plug comprising the ceramic heater according to claim 1.

* * * * *